US011649694B2

(12) United States Patent
Hammer et al.

(10) Patent No.: US 11,649,694 B2
(45) Date of Patent: May 16, 2023

(54) OPEN HOLE MULTI-ZONE SINGLE TRIP COMPLETION SYSTEM

(71) Applicants: Aaron C. Hammer, Houston, TX (US); Daniel Quinton Napier, Madisonville, LA (US)

(72) Inventors: Aaron C. Hammer, Houston, TX (US); Daniel Quinton Napier, Madisonville, LA (US)

(73) Assignee: BAKER HUGHES OILFIELD OPERATIONS LLC, Houston, TX (US)

( * ) Notice: Subject to any disclaimer, the term of this patent is extended or adjusted under 35 U.S.C. 154(b) by 0 days.

(21) Appl. No.: 17/545,182

(22) Filed: Dec. 8, 2021

(65) Prior Publication Data

US 2022/0307346 A1 Sep. 29, 2022

Related U.S. Application Data

(60) Provisional application No. 63/167,368, filed on Mar. 29, 2021.

(51) Int. Cl.
*E21B 23/01* (2006.01)
*E21B 23/06* (2006.01)
*E21B 34/06* (2006.01)

(52) U.S. Cl.
CPC ..... *E21B 34/066* (2013.01); *E21B 23/01* (2013.01); *E21B 23/06* (2013.01)

(58) Field of Classification Search
CPC ..... E21B 23/01; E21B 23/06; E21B 34/066
See application file for complete search history.

(56) References Cited

U.S. PATENT DOCUMENTS 3,323,360 A * 6/1967 Nutter ..... E21B 47/10 73/152.28
10,781,674 B2 * 9/2020 Bourgneuf ..... E21B 33/12
(Continued)

FOREIGN PATENT DOCUMENTS

EP 0554013 A1 8/1993
WO WO-2016069863 A1 * 5/2016 ..... E21B 33/12
WO WO-2022212154 A1 * 10/2022 ..... E21B 23/01

OTHER PUBLICATIONS

International Search Report and Written Opinion dated Jul. 12, 2022 in PCT/US2022/021644; 13 pages.

*Primary Examiner* — Daniel P Stephenson
(74) *Attorney, Agent, or Firm* — Cantor Colburn LLP

(57) ABSTRACT

A multi-zone single trip open hole completion system includes an outer tubular assembly including an uphole end, a downhole end, an inner tubular assembly, an anchor arranged on the outer tubular assembly, and an anchor setting assembly provided on one of the outer tubular assembly and the inner tubular assembly. The anchor setting assembly is operable to selectively set the anchor. An isolation flow path is in the outer tubular. A flow control system is arranged on the inner tubular assembly. The flow control system selectively blocks flow through the inner tubular assembly. A remotely operated valve is arranged in one of the inner tubular assembly and the outer tubular assembly. The remotely operated valve is operable to close fluid flow through the tubular. An isolation packer is arranged along the outer tubular assembly. Closing the remotely operated valve enables the anchor, and the isolation packer to be set.

25 Claims, 13 Drawing Sheets

(56) References Cited

U.S. PATENT DOCUMENTS

| | | | | |
|---|---|---|---|---|
| 11,473,408 | B2 * | 10/2022 | Newton | E21B 23/0413 |
| 2007/0084605 | A1 * | 4/2007 | Walker | E21B 43/08 166/313 |
| 2014/0251609 | A1 * | 9/2014 | Broussard | E21B 34/102 166/278 |
| 2015/0047837 | A1 * | 2/2015 | Turner | E21B 43/12 166/254.2 |
| 2016/0168950 | A1 * | 6/2016 | Delgado | E21B 34/08 166/321 |
| 2019/0284933 | A1 | 9/2019 | Tiwari et al. | |
| 2021/0230947 | A1 * | 7/2021 | Macek | E21B 43/26 |
| 2022/0307346 | A1 * | 9/2022 | Hammer | E21B 23/01 |

* cited by examiner

OPEN HOLE MULTI-ZONE SINGLE TRIP COMPLETION SYSTEM

CROSS-REFERENCE TO RELATED APPLICATIONS

This application claims the benefit of U.S. Provisional Application No. 63/167,368, filed Mar. 29, 2021, the contents of which are incorporated by reference herein in their entirety.

BACKGROUND

In the drilling and completion industry, completions are constructed in a bore hole to facilitate resource recovery. A lower completion is usually run in on a service string. Fluids are circulated through the bottom of the completion to remove debris and maintain well control. In a cased bore hole, a sump packer is often arranged at a lower portion of a casing tubular and installed prior to running the completion string. The completion string can be sealed into the sump packer. At this point, pressure may be built up within the completion to set packers and/or activate other tools. In an open hole environment, there is no casing tubular at the bottom portion of the bore hole and no sump packer.

In an open hole environment, the completion is run in with fluids passing through the bottom to remove debris and maintain well control. Once the completion is in position, objects (such as a ball) are often circulated down hole via the service string to sequentially activate packers and/or other components. After activation, the objects may require circulation out of the service string to remove the obstruction in the tubular bore and continue subsequent operations such as stimulation or sand control operations. Removing an object may include reverse flow, forcing the object passed an object seat, or degrading the object to open the flow path. The use of objects is a time-consuming process that increases well operations. The industry would welcome a system for activating components in an open hole environment that would reduce rig time before additional operations can commence.

SUMMARY

Disclosed is a multi-zone single trip open hole completion system including an outer tubular assembly including an uphole end, a downhole end, and an intermediate portion, an inner tubular assembly, an anchor arranged on the outer tubular assembly, an anchor setting assembly provided on one of the outer tubular assembly and the inner tubular assembly, the anchor setting assembly being operable to selectively set the anchor, an isolation flow path in the outer tubular, an object seat arranged on the inner tubular and the outer tubular. The object seat is receptive of an object that blocks flow through the one of the inner tubular and the outer tubular. A remotely operated valve is arranged in the tubular. The remotely operated valve is operable to close fluid flow through the tubular. An isolation packer is arranged along the intermediate portion. Closing the remotely operated valve enables the anchor, and the isolation packer to be set.

Also disclosed is a multi-zone single trip open hole completion system including a tubular assembly including an uphole end, a downhole end, and an intermediate portion, an anchor arranged on the tubular assembly, and a remotely operated valve arranged in the tubular assembly. The remotely is operated valve being operable to close the downhole end of the tubular assembly to fluid flow. An isolation packer is arranged along the intermediate portion, wherein closing the remotely operated valve enables the anchor and the isolation packer to be set.

Further disclosed is a multi-zone single trip open hole completion system including an inner tubular assembly, an outer tubular assembly, an anchor coupled to the outer tubular, an anchor setting assembly operable to selectively activate the anchor, an isolation flow path in the outer tubular, and an object seat arranged on the outer tubular assembly. The object seat is being receptive of an object to block flow through the outer tubular assembly. An isolation packer is arranged along the intermediate portion, wherein bypassing the object seat enables the isolation packer to be set.

Still further disclosed is a method of forming a multi-zone single trip open hole completion including running a multi-zone single trip open hole completion assembly including an anchor and an isolation packer into an open hole well bore to a selected depth, flowing fluid through a bottom hole assembly (BZA) of the completion assembly during run in, closing a remotely operated valve arranged in the BZA to stop the flow of fluid, and setting the anchor and the isolation packer by applying pressure to the completion assembly.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
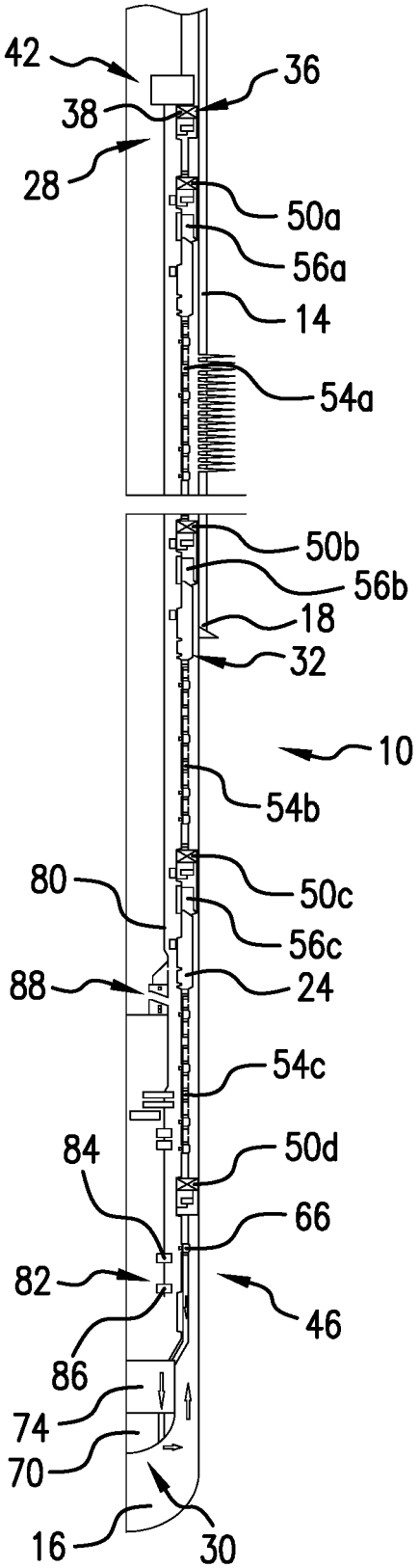
FIG. 1 depicts a multi-zone single trip completion system with an open hole lower zone assembly in a run in configuration, in accordance with a non-limiting example.

A multi-zone single trip open hole completion system is generally indicated at 10 in FIG. 1. When installed, the multi-zone single trip open hole completion assembly 10 is supported at a casing tubular 14 arranged in a well bore 16. Casing tubular 14 includes a terminal end 18, below which is an open bore hole. In a non-limiting example, multi-zone single trip open hole completion assembly 10 includes an outer string assembly, shown in the form of an outer tubular assembly 24 having an uphole end 28 that is arranged within casing tubular 14, a downhole end 30 arranged within the open bore hole of well bore 16, and an intermediate portion 32.

In a non-limiting example, multi-zone single trip open hole completion assembly 10 includes an anchor 36 arranged at uphole end 28. Anchor 36 selectively engages with an inner surface (not-separately labeled) of casing tubular 14 to support outer tubular assembly 24. Anchor 36 does not seal against the inner surface of casing tubular 14 and may take the form of an assembly that contains slips 38. An anchor setting assembly 42 may be arranged adjacent anchor 36. Anchor setting assembly 42 may be employed to set anchor 36 as will be detailed herein.

Multi-zone single trip open hole completion assembly 10 also include a bottom zone assembly (BZA) 46 arranged at downhole end 30 and a plurality of isolation packers 50*a*, 50*b*, 50*c*, and 50*d* arranged along intermediate portion 32. The number and location of isolation packers 50*a-d* may vary. Production screens, such as shown at 54*a*, 54*b*, and 54*c* may be arranged between adjacent ones of isolation packers 50*a-d*. Further, outer tubular system 24 may also support a number of slurry outlets 56*a*, 56*b*, and 56*c* that may be associated with each production screen 51*a-c*. Slurry outlets 56*a-c* may be used, for example, during a gravel pack operation. With this arrangement, well bore 16 may be divided into a number of production zones that are isolated from one another.

Figure 2:
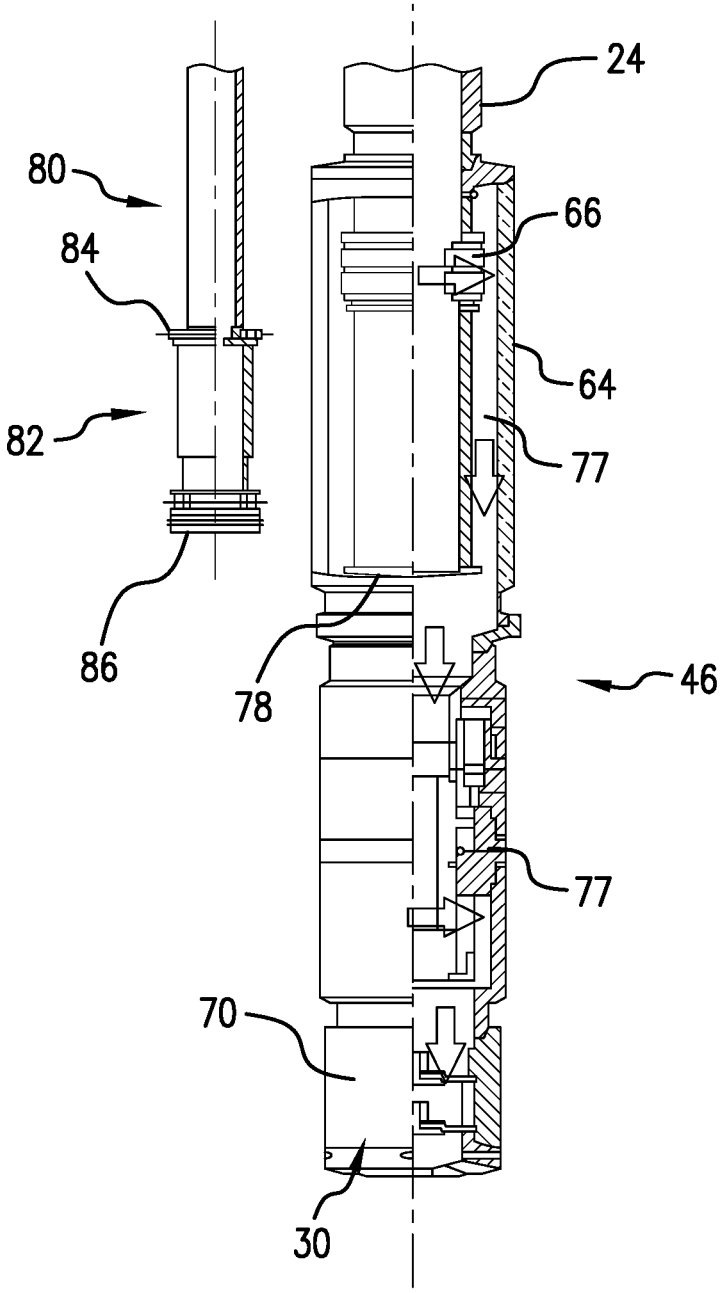
FIG. 2 depicts a bottom hole assembly including a remotely actuated well isolation valve of the multi-zone single trip open hole completion assembly of FIG. 1, in accordance with a non-limiting example.

Reference will now follow to FIG. 2, with continued reference to FIG. 1, in describing BZA 46 in accordance with a non-limiting example. BZA 46 includes a housing 64 that surrounds an isolation flow path, which, in a non-limiting example, may take the form of an isolation valve 66. It should be understood that the isolation flow path may take on various formed including one or more orifices that may be selectively blocked. BZA 46 is also shown to include and a float shoe 70.

In a non-limiting example, a remotely operated valve 74 is arranged between isolation valve 66 and float shoe 70. At this point, it should be understood that remotely operated valve 74 may take on various forms including an electronically operated valve or an electrically operated valve. An electronically operated valve may include, for example, integrated circuits, processors and/or the like. Remotely operated valve 74 may also be a simple electrically operated device that is devoid of processor, circuitry, and the like. Remotely operated valve 74 may also take on other forms including various valve types, including rupture discs that may be activated from the surface with and/or without the need for mechanical intervention. A flow path 77 is defined between housing 64 and outer tubular assembly 24. A plug 78 is arranged at a terminal end (not separately labeled) of outer tubular assembly 24. Plug 78 blocks off the terminal end of outer tubular assembly 24 forcing fluid to flow through isolation valve 66. While described as using plug 78 to force fluid through isolation valve 66 into flow path 77, other systems may also be used to allow pressure to be built up in outer tubular assembly 24 such as seal bores, other plugs, shifting sleeves, shifting pistons and the like are also contemplated.

Flow path 77 allows fluids from the surface to flow through multi-zone single trip open hole completion assembly 10 and out from float shoe 70 during run in. In a non-limiting example, multi-zone single trip open hole completion assembly 10 may be run in on an inner tubular assembly or service string 80 that may include multiple selective shifting tools, such as shown at 82. Shifting tools 82 may include a closing tool 84 that may mechanically close isolation valve 66 and an opening tool 86 that may mechanically open isolation valve 66.

Figure 3:
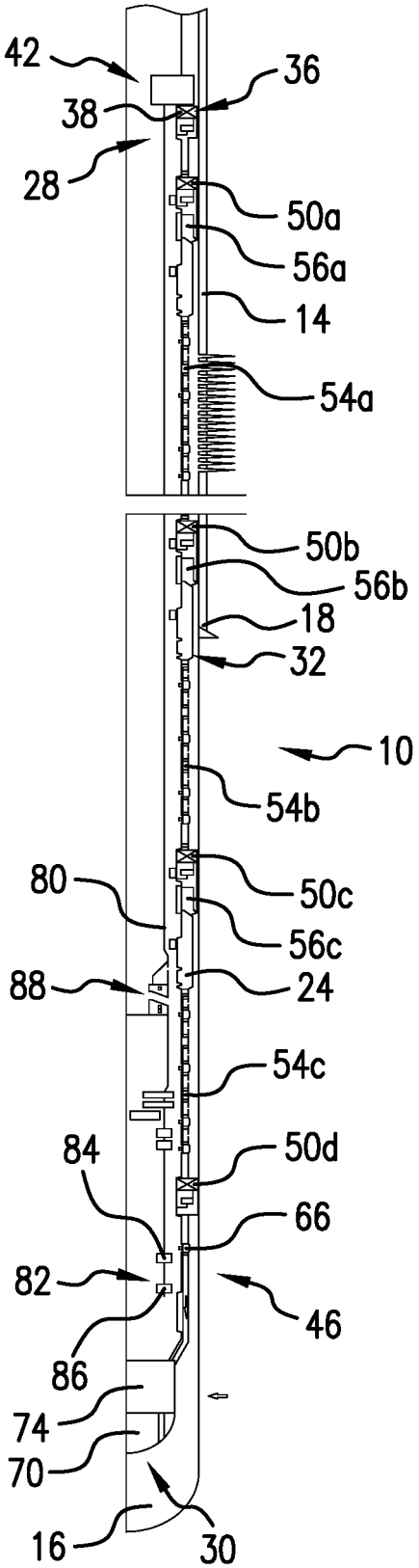
FIG. 3 depicts the multi-zone single trip open hole completion system after closing the remotely actuated well isolation valve, in accordance with a non-limiting example.

In a non-limiting example, multi-zone single trip open hole completion assembly 10 is run into well bore 16 to a selected depth. During run-in, remotely operated valve 74 is open allowing fluids to flow through isolation valve 66 along flow path 77 and out through float shoe 70. This forward flow of fluid helps control debris and maintain well control. Once at the selected depth, a signal is sent from, for example, a surface control station (not shown) to remotely operated valve 74. The signal may take on many forms and may be an electric signal passed along a control line, fluid pulses, acoustic signals, a signal passed through a formation or the like. In response to receiving the signal, remotely operated valve 74 closes as shown in FIG. 3.

Figure 4:
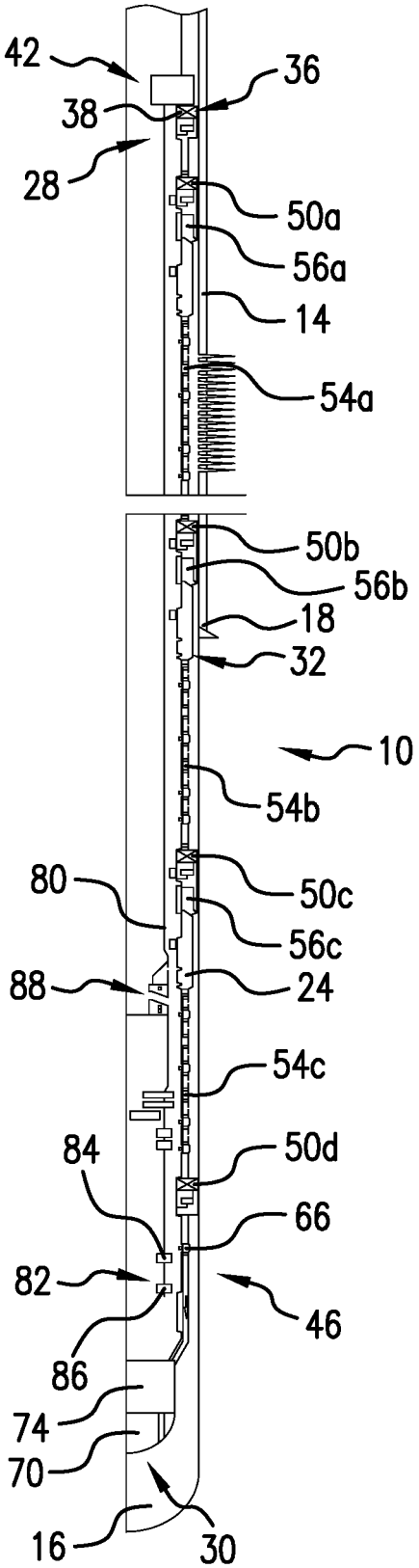
FIG. 4 depicts the multi-zone single trip open hole completion system of FIG. 3 after setting a top anchor, and a plurality of isolation packers, in accordance with a non-limiting example.

Once remotely operated valve 74 closes, pressure may be applied to outer tubular assembly 24 which, in a non-limiting example, sets, as a group, anchor 36 and each of the plurality of isolation packers 50*a-d* and disconnects inner tubular assembly 80 from outer tubular assembly 24 as shown in FIG. 4. Setting isolation packers 50*a*-d as a group creates the multiple isolated production zones (not separately labeled) and reduces any likelihood that crossflow may exist between adjacent production zones. Further, setting anchor 36 and the plurality of isolation packers 50*a-d* with pressure eliminates the need to circulate an object into and out from the multi-zone single trip open hole completion assembly 10 thereby saving rig time.

In the event that remotely operated valve 74 fails to close as detected by, for example, an inability of outer tubular assembly 24 to hold pressure, multi-zone single trip open hole completion assembly 10 using, for example, anchor setting assembly 42 may still be effective as shown in FIGS. 5-8.

Figure 5:
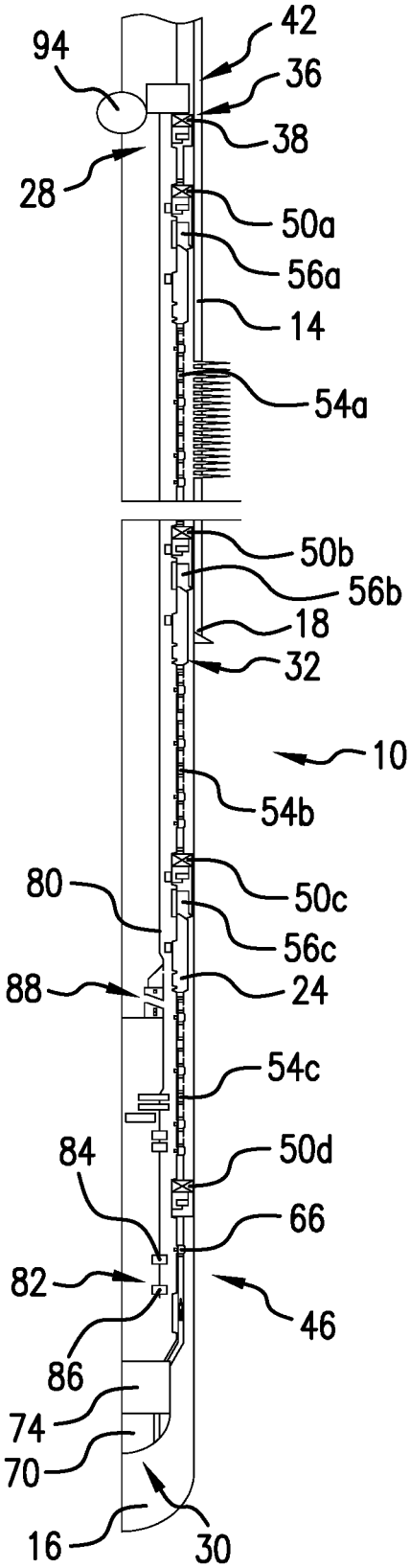
FIG. 5 depicts dropping an object into an anchor setting assembly of the multi-zone single trip open hole completion system to set the top anchor if the remotely actuated well isolation valve fails to close, in accordance with a non-limiting example.
Figure 6:
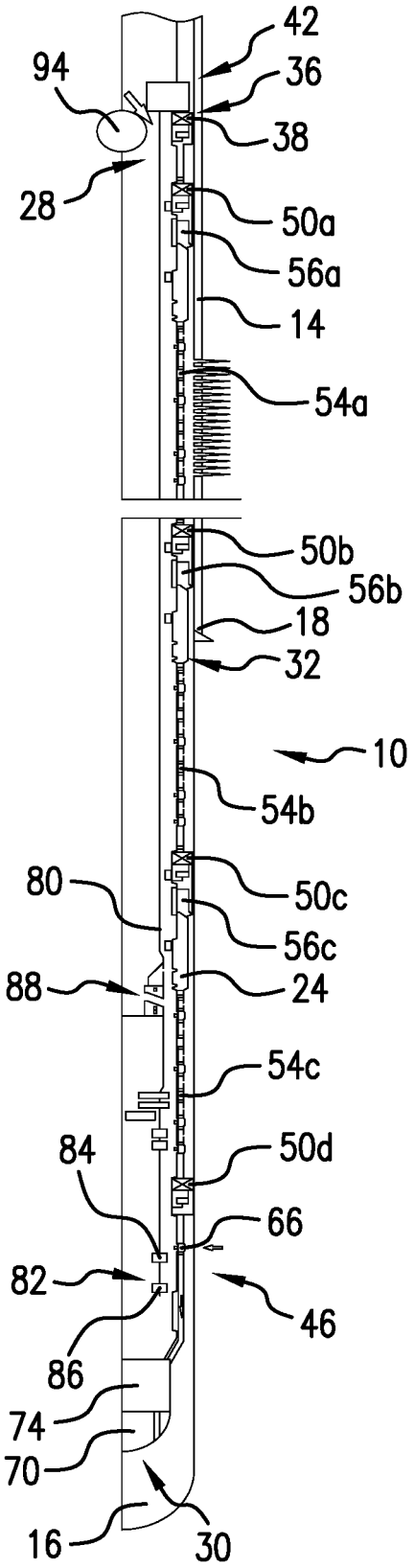
FIG. 6 depicts exposing a bypass flow path in the anchor setting assembly, in accordance with a non-limiting example.
Figure 7:
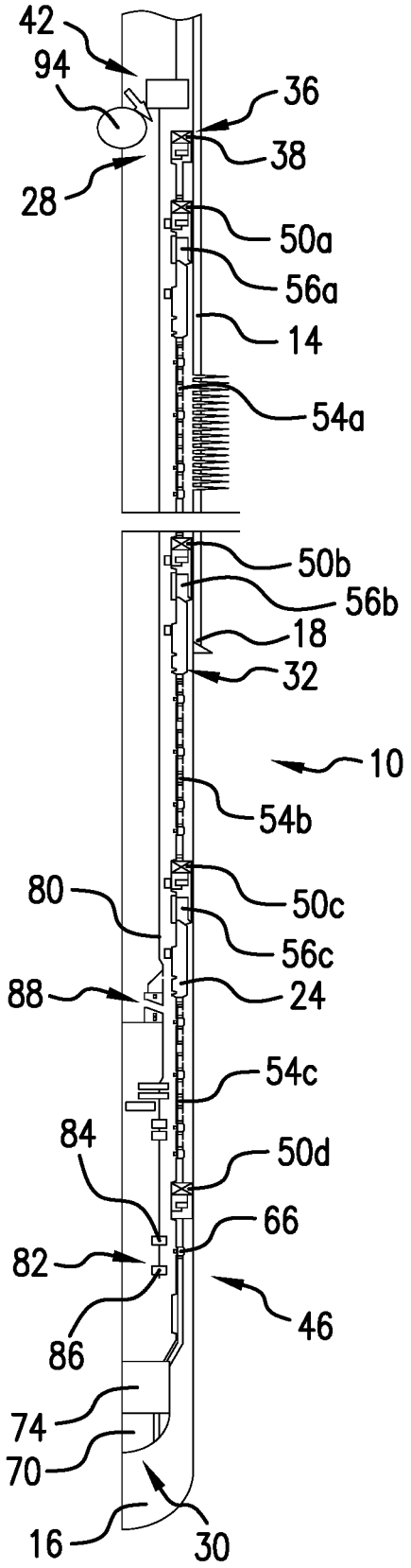
FIG. 7 depicts a service string being picked up to close the isolation valve, in accordance with a non-limiting example.

In a non-limiting example, if remotely operated valve 74 fails to close flow path 77, an object, such as a drop ball 94 may be introduced into inner tubular assembly 80 as shown in FIG. 5. Object 94 is pumped down to anchor setting assembly 42. As will be detailed herein, pressure is applied to object 94 causes anchor setting assembly 42 to set anchor 36 and disconnect inner tubular assembly 80 from outer tubular assembly 24 as shown in FIG. 6. Once anchor 36 is set, service string 80 may be picked up to close isolation valve 66 and open a bypass flow path as shown in FIG. 7 as will be detailed herein.

Figure 8:
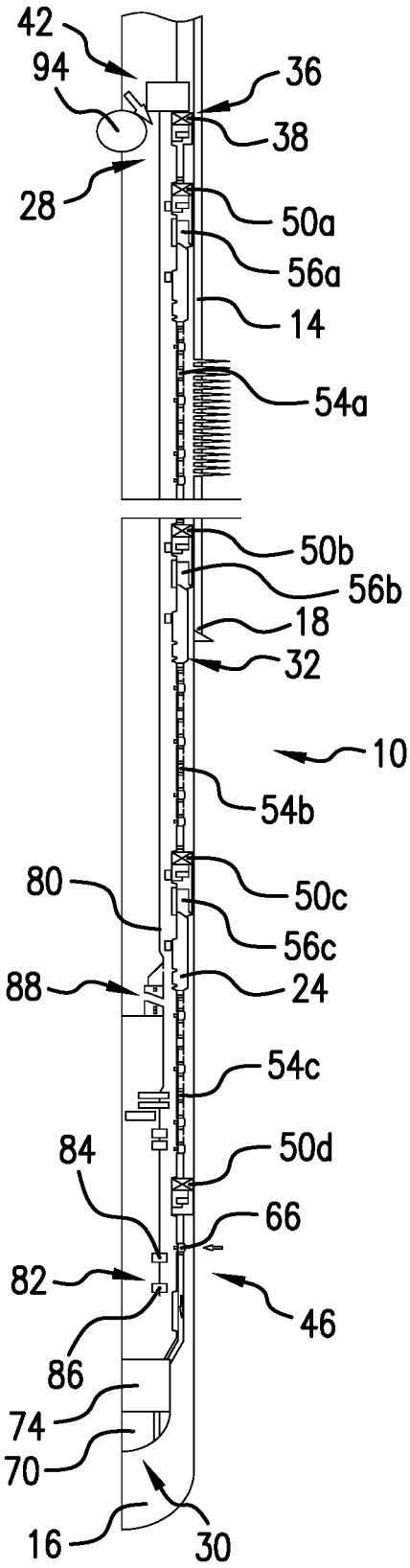
FIG. 8 depicts flowing fluid through the bypass flow path to set, the plurality of isolation packers after the service string is set back down, in accordance with a non-limiting example.

Service string 80 is set back down as shown in FIG. 8 and pressure applied to outer tubular assembly 24 causing isolation packers 50*a-d* to set, as a group to establish multiple production zones (not separately labeled). It should be understood that the object may be introduced into the inner tubular assembly or service string 80 or outer tubular assembly 24 to block a flow path and generate pressure to set the anchor. It should also be understood that while shown as being part of service string 80 and located an uphole end 28 of outer tubular assembly 24, anchor setting assembly 42 may be arranged in various locations. While isolation is shown to be a valve, other systems for closing inner tubular assembly 80 are also contemplated including straddling seals, plugging downhole end 30, dropping an object 94 and the like.

Figure 9:
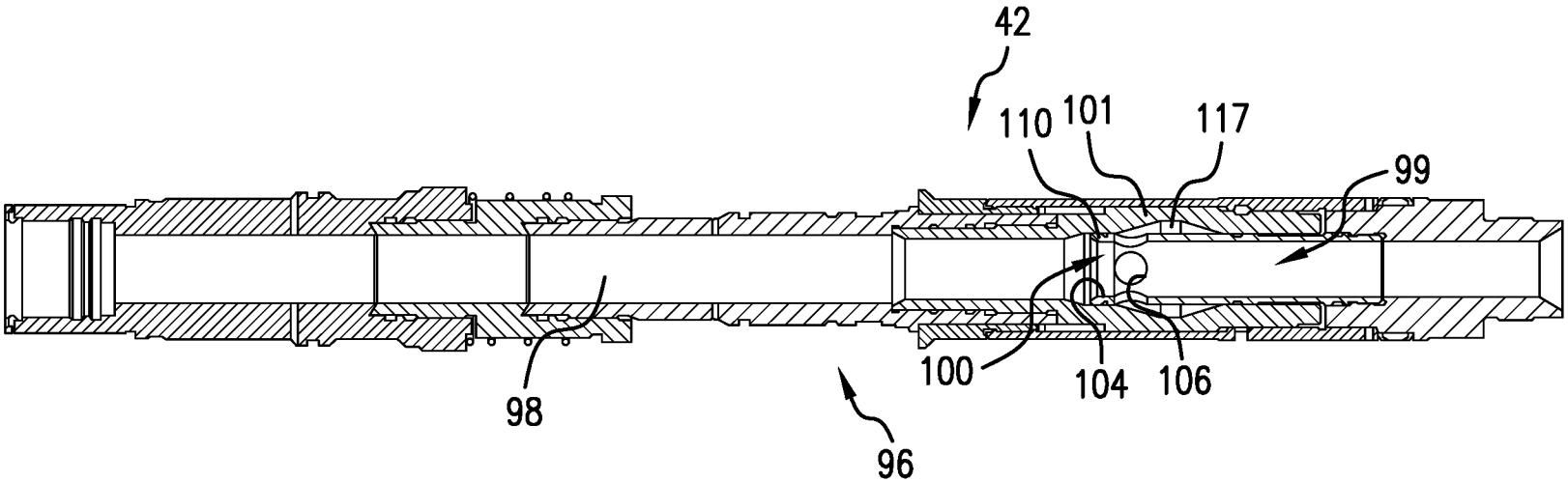
FIG. 9 is a cross-sectional view of the anchor setting assembly in a run in configuration, in accordance with a non-limiting example.
Figure 10:
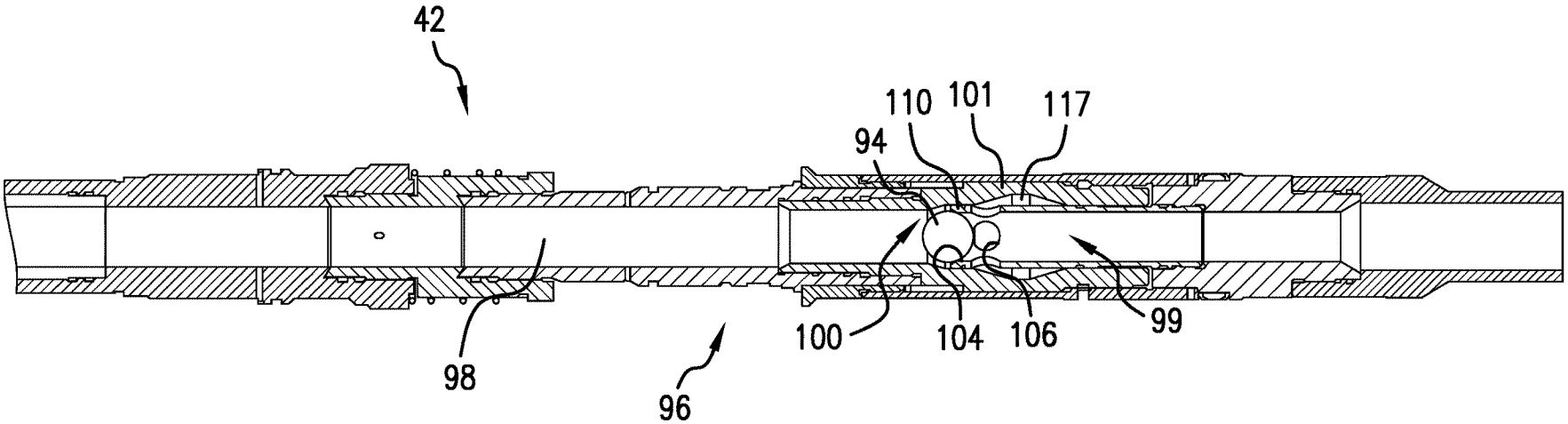
FIG. 10 depicts the anchor setting assembly of FIG. 9 after landing an object to set the top anchor, in accordance with a non-limiting example.
Figure 11:
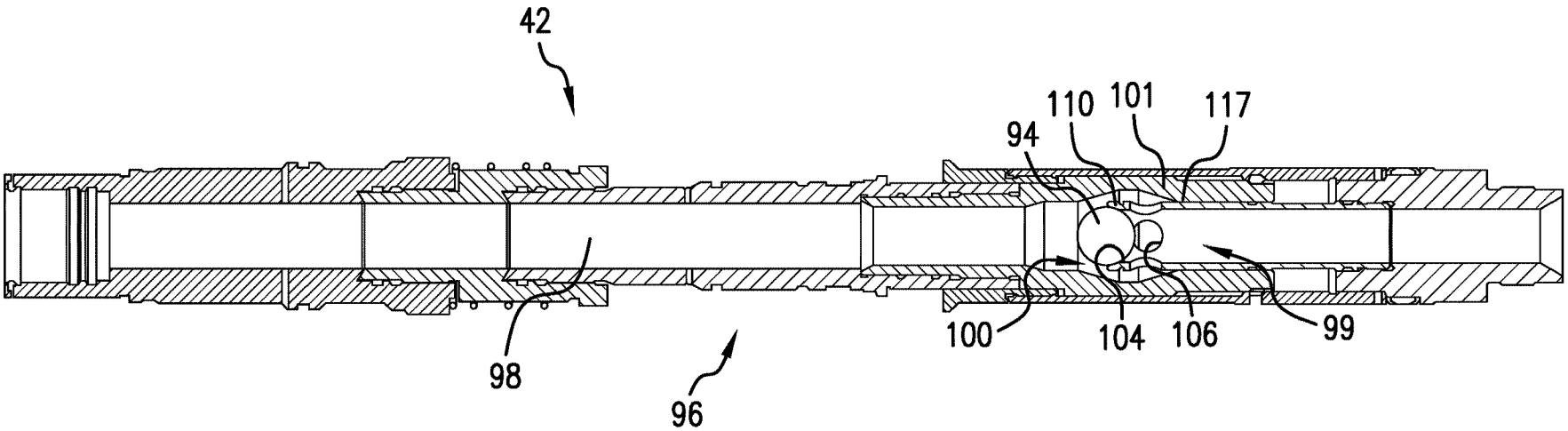
FIG. 11 depicts the anchor setting assembly of FIG. 10 after opening the bypass flow path, in accordance with a non-limiting example.

Reference will now follow to FIGS. 9-11 in describing anchor setting assembly 42 in accordance with a non-limiting example. Anchor setting assembly 42 includes a body 96 defining a conduit 98. A flow control system 99 is arranged in body 96. Flow control system 99 may include an object seat 100 that may support object 94 and is surrounded by a sleeve 101. As will be detailed herein, object seat 100 may be selectively shifted relative to sleeve 101. Object seat 100 includes a first opening 104 aligned with conduit 98 and a plurality of second radially disposed openings 106. Object seat 100 is also shown to include an object capture member 110. Object capture member 110 prevents object 94 from moving off of object seat 100. In a non-limiting example, sleeve 101 includes an enlarged diameter portion 114 that forms a bypass flow path 117 as will be detailed herein.

It should be understood that while shown as being part of anchor setting assembly 42, flow control system 99 may be located in alternative positions such as at downhole end 30 of outer tubular assembly 24 or within service string 80. Anchor setting assembly 42 may set anchor 36 before the production zones are isolated one from another. At this point it should be understood that while flow control system 99 was described as including an object seat that may be receptive of an object which is later bypassed, other systems for selectively blocking and unblocking inner tubular 80, outer tubular assembly 24 and/or completion assembly 10 are also contemplated. For example, a second remotely operated valve could be deployed on inner tubular 80. The second remotely operated valve could be operated with a signal from surface or manipulation of the inner tubular assembly 10.

During run in, anchor conduit 98 is unobstructed such as shown in FIG. 9. If remotely operated valve 74 does not activate, a flow control device, such as an object 94 is introduced into inner tubular assembly 80 and landed on object seat 100 blocking conduit 98 as shown in FIG. 10. Pressure is applied to object 94 causing anchor 36 to engage casing tubular 14. After anchor 36 is set, service string 80 is picked up thereby shifting sleeve 101 upwardly such that, in addition to closing isolation valve 66, enlarged diameter portion 114 surrounds object 94 as shown in FIG. 11. In this position, the plurality of second radially disposed openings 106 are exposed to bypass flow path 117 to reestablish a fluid flow path thereby allowing fluid to flow past object 94 toward float shoe 70. With isolation valve 66 being closed, pressure may build in outer tubular assembly 24. The pressure may be used to set the isolation packers.

Figure 12:
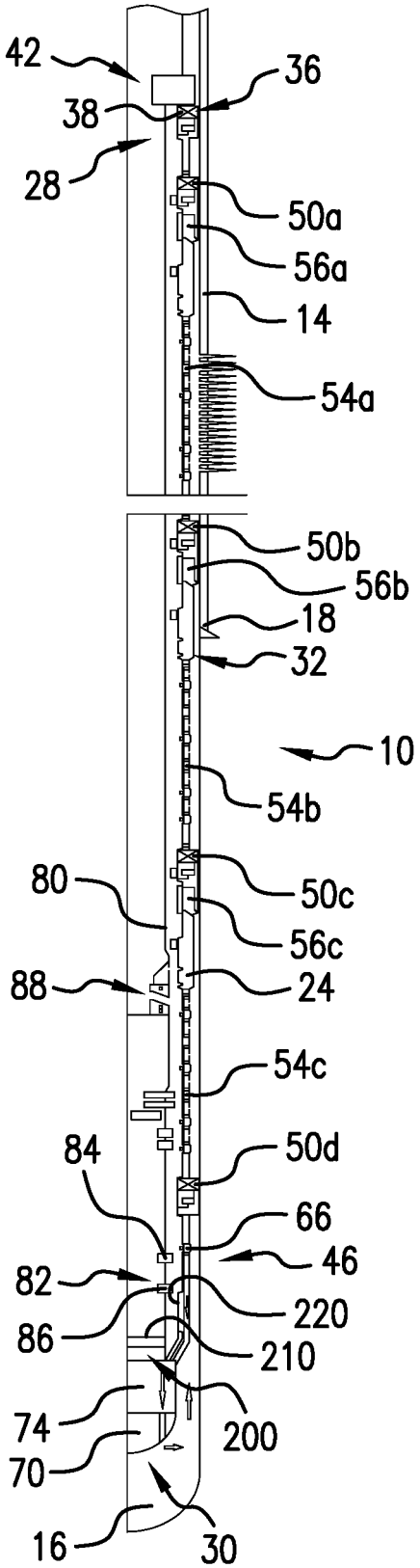
FIG. 12 depicts a multi-zone single trip completion system with an open hole lower zone assembly in a run in configuration, in accordance with another non-limiting example.
Figure 13:
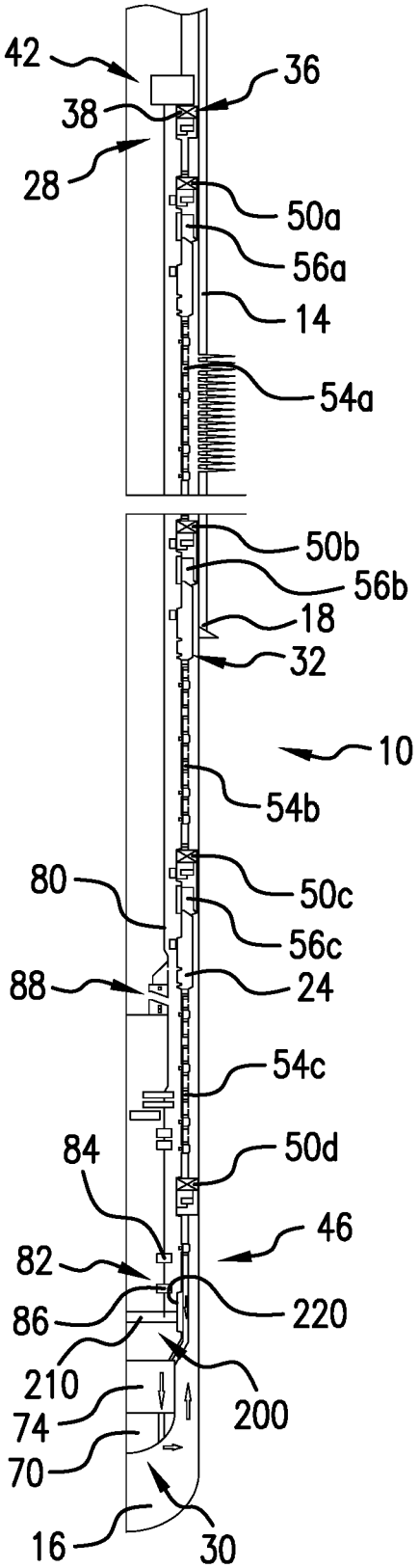
FIG. 13 depicts the multi-zone single trip open hole completion system of FIG. 12 after closing the remotely actuated well isolation valve, in accordance with a non-limiting example.

Reference will now follow to FIGS. 12 and 13, wherein like reference numbers represent corresponding parts in the respective views, in describing an isolation valve 200 in accordance with another non-limiting example. Instead of an isolation valve incorporated into BZA 46, isolation valve 200 may take the form of a plug 210 that is mounted to a terminal end (not separately labeled) of service string 80. Plug 210 may be positioned below shifting tools 82. In a non-limiting example, isolation valve 200 may transition between an open position as shown in FIG. 11 to a closed position, as shown in FIG. 12. In the closed position, plug 210 may seal against an internal surface 220 of outer tubular assembly 24 shutting off flow through float shoe 70. At this point it should be understood that the exemplary embodiments describe a system for setting an anchor and setting, as a group, a plurality of isolation packers in an open hole well bore without the need to circulate and or reverse circulate multiple objects or for multiple trips into the well bore. After the packers are set, service string 80 may be shifted upwardly to open each zone to production or perform other operations such as stimulation without concern that cross flow will occur. Eliminating cross flow will reduce the potential for reservoir damage or the introduction of debris into the wellbore. Prior to setting the isolation packers, hydrostatic pressure is maintained on the production zones by use of a non-sealing anchor. Other methods of maintaining hydrostatic pressure on the formation zones may also be employed such as additional sleeves or bypass flow paths.

Set forth below are some embodiments of the foregoing disclosure:

Embodiment 1. A multi-zone single trip open hole completion system comprising: an outer tubular assembly including an uphole end, a downhole end, and an intermediate portion; an inner tubular assembly; an anchor arranged on the outer tubular assembly; an anchor setting assembly provided on one of the outer tubular assembly and the inner tubular assembly, the anchor setting assembly being operable to selectively set the anchor; an isolation flow path in the outer tubular; a flow control system arranged on the inner tubular assembly, the flow control system selectively blocking flow through the inner tubular assembly; a remotely operated valve arranged in one of the inner tubular assembly and the outer tubular assembly, the remotely operated valve being operable to close fluid flow through the tubular; and an isolation packer arranged along the intermediate portion, wherein closing the remotely operated valve enables the anchor, and the isolation packer to be set.

Embodiment 2. A multi-zone single trip open hole completion system comprising: a tubular assembly including an uphole end, a downhole end, and an intermediate portion; an anchor arranged on the tubular assembly; a remotely operated valve arranged in the tubular assembly, the remotely operated valve being operable to close the downhole end of the tubular assembly to fluid flow; and an isolation packer arranged along the intermediate portion, wherein closing the remotely operated valve enables the anchor and the isolation packer to be set.

Embodiment 3. The multi-zone single trip open hole completion system according to any prior embodiment, further comprising: an isolation flow path including an isolation valve arranged in the tubular assembly.

Embodiment 4. The multi-zone single trip open hole completion system according to any prior embodiment, wherein the anchor is a non-sealing anchor that does not form a seal with a surface of the wellbore.

Embodiment 5. The multi-zone single trip open hole completion system according to any prior embodiment, further comprising: an anchor setting assembly arranged in the tubular at the anchor.

Embodiment 6. The multi-zone single trip open hole completions system according to any prior embodiment, wherein, the flow control system includes an object seat and a selectively activatable bypass flow path.

Embodiment 7. A multi-zone single trip open hole completion system comprising: an inner tubular assembly; an outer tubular assembly; an anchor arranged on the outer tubular; an anchor setting assembly operable to selectively activate the anchor; an isolation flow path in the outer tubular assembly; a flow control system arranged on the inner tubular assembly, the flow control system selectively blocking flow through the inner tubular assembly; and an isolation packer arranged along the outer tubular, wherein the flow control system includes a bypass that enables the isolation packer to be set.

Embodiment 8. The multi-zone single trip open hole completion system according to any prior embodiment, wherein the anchor is a non-sealing anchor that does not form a seal with a surface of the wellbore.

Embodiment 9. The multi-zone single trip open hole completion system according to any prior embodiment, further comprising: an isolation valve arranged above the downhole end of the tubular.

Embodiment 10. The multi-zone single trip open hole completion system according to any prior embodiment, wherein the flow control system includes an object seat.

Embodiment 11. The multi-zone single trip open hole completion system according to any prior embodiment, wherein the flow control system forms part of the anchor setting assembly and the object seat includes an object capture member.

Embodiment 12. A method of forming a multi-zone single trip open hole completion comprising: running a multi-zone single trip open hole completion assembly including an anchor and an isolation packer into an open hole well bore to a selected depth; flowing fluid through a bottom hole assembly (BZA) of the completion assembly during run in; closing a remotely operated valve arranged in the BZA to stop the flow of fluid; and setting the anchor and the isolation packer by applying pressure to the completion assembly.

Embodiment 13. The method according to any prior embodiment, further comprising: detecting that the remotely operated valve did not function; and setting the anchor with a flow control system that blocks flow through an inner tubular assembly.

Embodiment 14. The method according to any prior embodiment, further comprising: opening a bypass flow path to bypass the flow control system.

Embodiment 15. The method according to any prior embodiment, further comprising: closing an isolation flow path in the completion assembly.

Embodiment 16. The method according to any prior embodiment, further comprising: flowing additional fluid through the bypass flow path to set the isolation packer.

Embodiment 17. The method according to any prior embodiment, wherein when setting the anchor occurs before production zones in the open hole well bore are isolated one from another.

Embodiment 18. The method according to any prior embodiment, wherein setting the anchor includes engaging the anchor with surface of a casing tubular.

Embodiment 19. The method according to any prior embodiment, wherein setting the isolation packer includes setting a plurality of isolation packers.

Embodiment 20. The method according to any prior embodiment, wherein setting the plurality of isolation packers includes setting at least one of the plurality of isolation packers against the casing tubular and another of the plurality of isolation packers against a surface of the open hole well bore.

Embodiment 21. The method according to any prior embodiment, wherein setting the isolation packer includes setting a plurality of isolation packers as a group.

Embodiment 22. A method of forming a multi-zone single trip open hole completion comprising: running a multi-zone single trip open hole completion assembly including an anchor and an isolation packer into an open hole well bore to a selected depth; flowing fluid through a bottom zone assembly (BZA) of the completion assembly during run in; setting the anchor with an anchor setting assembly; blocking the fluid flowing through the BZA; and setting the isolation packer by applying pressure to the completion assembly.

Embodiment 23. The method according to any prior embodiment, wherein setting the anchor includes operating a flow control system to increase pressure at the anchor setting assembly.

Embodiment 24. The method according to any prior embodiment, wherein operating the flow control system includes dropping an object onto an object seat.

Embodiment 25. The method according to any prior embodiment, wherein setting the isolation packer includes bypassing the flow control system.

Embodiment 26. The method according to any prior embodiment, wherein blocking the fluid flow includes picking up a closing tool to close an isolation valve.

The use of the terms "a" and "an" and "the" and similar referents in the context of describing the invention (especially in the context of the following claims) are to be construed to cover both the singular and the plural, unless otherwise indicated herein or clearly contradicted by context. Further, it should be noted that the terms "first," "second," and the like herein do not denote any order, quantity, or importance, but rather are used to distinguish one element from another.

The terms "about" and "substantially" are intended to include the degree of error associated with measurement of the particular quantity based upon the equipment available at the time of filing the application. For example, "about" and/or "substantially" can include a range of ±8% or 5%, or 2% of a given value.

The teachings of the present disclosure may be used in a variety of well operations. These operations may involve using one or more treatment agents to treat a formation, the fluids resident in a formation, a wellbore, and/or equipment in the wellbore, such as production tubing. The treatment agents may be in the form of liquids, gases, solids, semi-solids, and mixtures thereof. Illustrative treatment agents include, but are not limited to, fracturing fluids, acids, steam, water, brine, anti-corrosion agents, cement, permeability modifiers, drilling muds, emulsifiers, demulsifiers, tracers, flow improvers, sands, proppants, etc. Illustrative well operations include, but are not limited to, hydraulic fracturing, gravel packing, stimulation, tracer injection, cleaning, acidizing, steam injection, water flooding, cementing, etc.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited.

What is claimed is:

1. A multi-zone single trip open hole completion system comprising:

an outer tubular assembly including an uphole end, a downhole end, and an intermediate portion;

an inner tubular assembly;

an anchor arranged on the outer tubular assembly;

an anchor setting assembly provided on one of the outer tubular assembly and the inner tubular assembly, the anchor setting assembly being operable to selectively set the anchor;

an isolation flow path in the outer tubular;

a flow control system arranged on the inner tubular assembly, the flow control system selectively blocking flow through the inner tubular assembly;

a remotely operated valve arranged in one of the inner tubular assembly and the outer tubular assembly, the remotely operated valve being operable to close fluid flow through the outer tubular assembly; and an isolation packer arranged along the intermediate portion of the outer tubular assembly, wherein closing the remotely operated valve enables pressure to be applied to the outer tubular assembly to set the anchor, and the isolation packer.

2. A multi-zone single trip open hole completion system comprising:

a tubular assembly including an uphole end, a downhole end, and an intermediate portion;

an anchor arranged on the tubular assembly;

a remotely operated valve arranged in the tubular assembly, the remotely operated valve being operable to close the downhole end of the tubular assembly to fluid flow; and an isolation packer arranged along the intermediate portion, wherein closing the remotely operated valve enables pressure to be applied to the outer tubular assembly to set the anchor and the isolation packer.

3. The multi-zone single trip open hole completion system according to claim 2, further comprising: an isolation flow path including an isolation valve arranged in the tubular assembly.

4. The multi-zone single trip open hole completion system according to claim 2, wherein the anchor is a non-sealing anchor that does not form a seal with a surface of the wellbore.

5. The multi-zone single trip open hole completion system according to claim 2, further comprising: an anchor setting assembly arranged in the tubular at the anchor.

6. The multi-zone single trip open hole completions system according to claim 5, wherein, the flow control system includes an object seat and a selectively activatable bypass flow path.

7. A multi-zone single trip open hole completion system comprising:

an inner tubular assembly;

an outer tubular assembly;

an anchor arranged on the outer tubular;

an anchor setting assembly operable to selectively activate the anchor;

an isolation flow path in the outer tubular assembly;

a flow control system arranged on the inner tubular assembly, the flow control system including a flow control device that selectively blocks flow through the inner tubular assembly; and an isolation packer arranged along the outer tubular, wherein the flow control system includes a bypass flow path that enables fluid to bypass the flow control device to set the isolation packer.

8. The multi-zone single trip open hole completion system according to claim 7, wherein the anchor is a non-sealing anchor that does not form a seal with a surface of the wellbore.

9. The multi-zone single trip open hole completion system according to claim 7, further comprising: an isolation valve arranged above the downhole end of the tubular.

10. The multi-zone single trip open hole completion system according to claim 7, wherein the flow control system includes an object seat.

11. The multi-zone single trip open hole completion system according to claim 10, wherein the flow control system forms part of the anchor setting assembly and the object seat includes an object capture member.

12. A method of forming a multi-zone single trip open hole completion comprising:

running a multi-zone single trip open hole completion assembly including an anchor and an isolation packer into an open hole well bore to a selected depth;

flowing fluid through a bottom hole assembly (BZA) of the completion assembly during run in;

closing a remotely operated valve arranged in the BZA to stop the flow of fluid; and setting the anchor and the isolation packer by applying pressure to the completion assembly.

13. The method of claim 12, further comprising:

detecting that the remotely operated valve did not function; and setting the anchor with a flow control system that blocks flow through an inner tubular assembly.

14. The method of claim 13, further comprising: opening a bypass flow path to bypass the flow control system.

15. The method of claim 14, further comprising: closing an isolation flow path in the completion assembly.

16. The method of claim 15, further comprising: flowing additional fluid through the bypass flow path to set the isolation packer.

17. The method of claim 12, wherein when setting the anchor occurs before production zones in the open hole well bore are isolated one from another.

18. The method of claim 12, wherein setting the anchor includes engaging the anchor with surface of a casing tubular.

19. The method of claim 18, wherein setting the isolation packer includes setting a plurality of isolation packers.

20. The method of claim 19, wherein setting the plurality of isolation packers includes setting at least one of the plurality of isolation packers against the casing tubular and another of the plurality of isolation packers against a surface of the open hole well bore.

21. The method of claim 12, wherein setting the isolation packer includes setting a plurality of isolation packers as a group.

22. A method of forming a multi-zone single trip open hole completion comprising:

running a multi-zone single trip open hole completion assembly including an anchor and an isolation packer into an open hole well bore to a selected depth;

flowing fluid through a bottom zone assembly (BZA) of the completion assembly during run in;

setting the anchor by operating a flow control system to increase pressure at with an anchor setting assembly operable to set the anchor;

blocking the fluid flowing through the BZA; and setting the isolation packer by applying pressure to the completion assembly.

23. The method of claim 22, wherein operating the flow control system includes dropping an object onto an object seat.

24. The method of claim 22, wherein setting the isolation packer includes bypassing the flow control system.

25. The method of claim 22, wherein blocking the fluid flow includes picking up a closing tool to close an isolation valve.

* * * * *